US006690104B2

(12) United States Patent
Kim

(10) Patent No.: US 6,690,104 B2
(45) Date of Patent: Feb. 10, 2004

(54) SHADOW MASK IN COLOR CATHODE RAY TUBE

(75) Inventor: Sung Yeon Kim, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 251 days.

(21) Appl. No.: 09/839,148

(22) Filed: Apr. 23, 2001

(65) Prior Publication Data

US 2001/0043034 A1 Nov. 22, 2001

(30) Foreign Application Priority Data

Apr. 29, 2000 (KR) ..... 2000-23078

(51) Int. Cl.[7] ..... H01J 29/07
(52) U.S. Cl. ..... 313/402; 313/403
(58) Field of Search ..... 313/402, 403

(56) References Cited

U.S. PATENT DOCUMENTS 4,926,089 A * 5/1990 Moore ..... 313/403
4,942,332 A * 7/1990 Adler et al. ..... 313/403
5,055,736 A * 10/1991 Yun et al. ..... 313/402
6,437,496 B1 * 8/2002 Kim et al. ..... 313/403
6,472,806 B1 * 10/2002 Kim et al. ..... 313/403

* cited by examiner

*Primary Examiner*—Ashok Patel
(74) *Attorney, Agent, or Firm*—Fleshner & Kim, LLP

(57) ABSTRACT

A shadow mask in a color cathode ray tube is provided including a plurality of slots for passing electron beams therethrough, and a bridge between adjacent slots in a height direction, wherein a portion of the bridge is removed to combine a number of the slots, such that a removal area of the bridge is 1~30% of an area of the bridge. In another aspect of the present invention, a shadow mask in a color cathode ray tube is provided including a plurality of slots for passing electron beams therethrough, and a bridge between adjacent slots in a height direction, wherein a portion of the bridge is removed to combine a number of the slots, such that an open width of the bridge is 1~40% of a slot width.

21 Claims, 9 Drawing Sheets

SHADOW MASK IN COLOR CATHODE RAY TUBE

BACKGROUND OF THE INVENTION

1. Field of the Invention

The present invention relates to a cathode ray tube, and more particularly, to a shadow mask in a color cathode ray tube.

2. Background of the Related Art

Referring to FIG. 1, in general, the color cathode ray tube is provided with a panel 1 having R, G, B fluorescent films coated on an inside surface, a funnel 1 fusion welded to a rear end of the panel 1 for keeping inside of the color cathode ray tube in vacuum, an electron gun 5 sealed in a neck portion 3 of the funnel for emitting electron beams 4, a deflection yoke 6 for deflecting the electron beams emitted from the electron gun, and a shadow mask 7 for selecting a color of the electron beams deflected by the deflection yoke. Together with these, there are a frame assembly 8 for supporting the shadow mask 7, and springs 9 for fastening the frame assembly 8 to the panel 1 in the color cathode ray tube.

A picture reproducing process of the color cathode ray tube will be explained.

Upon reception of a video signal at the electron gun 5 sealed in the neck portion 3 of the funnel 2, electron beams 4 are emitted from cathodes (not shown) in the electron gun, controlled, accelerated, and converged, and modified of their paths in vertical and horizontal directions by a magnetic field of the deflection yoke 6, pass through the shadow mask 7, hit the fluorescent film 10 on the inside surface of the panel 1, to emit light and reproduce a picture.

Referring to FIG. 2, a related art shadow mask 7 will be explained in detail.

The shadow mask 7 is fitted to the panel 1 with a gap from the fluorescent film (see reference numeral 10 in FIG. 1). The color shadow mask 7 of a thin steel shielding plate has a plurality of slots 7*a* formed in the surface, each with a very small size to an extent almost invisible, which indicates that an amount of the electron beams passed through the slot 7*a* is very little, resulting in an amount of the electron beams that make the fluorescent film luminant is very little, to make a luminance, that gives a great influence to a quality of the color cathode ray tube, poor. Especially, an importance of the luminance becomes the greater day by day such that U.S. Pat. No. 4,926,089, and USP 4,942,332 are filed, according to which necessity for improving the luminance is kept increasing.

SUMMARY OF THE INVENTION

Accordingly, the present invention is directed to a shadow mask in a color cathode ray tube that substantially obviates one or more of the problems due to limitations and disadvantages of the related art.

An object of the present invention is to provide a shadow mask in a color cathode ray tube, which can improve a luminance, prevent moiré and doming in advance, and improve an effect of shadow elimination caused by an opened bridge.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the shadow mask in a color cathode ray tube includes a plurality of slots for passing electron beams therethrough, and a bridge between adjacent slots in a height direction, wherein a portion of the bridge is removed to combine a number of the slots, such that a removal area of the bridge is 1~30% of an area of the bridge.

In another aspect of the present invention, there is provided a shadow mask in a color cathode ray tube including a plurality of slots for passing electron beams therethrough, and a bridge between adjacent slots in a height direction, wherein a portion of the bridge is removed to combine a number of the slots, such that an open width of the bridge is 1~40% of a slot width.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
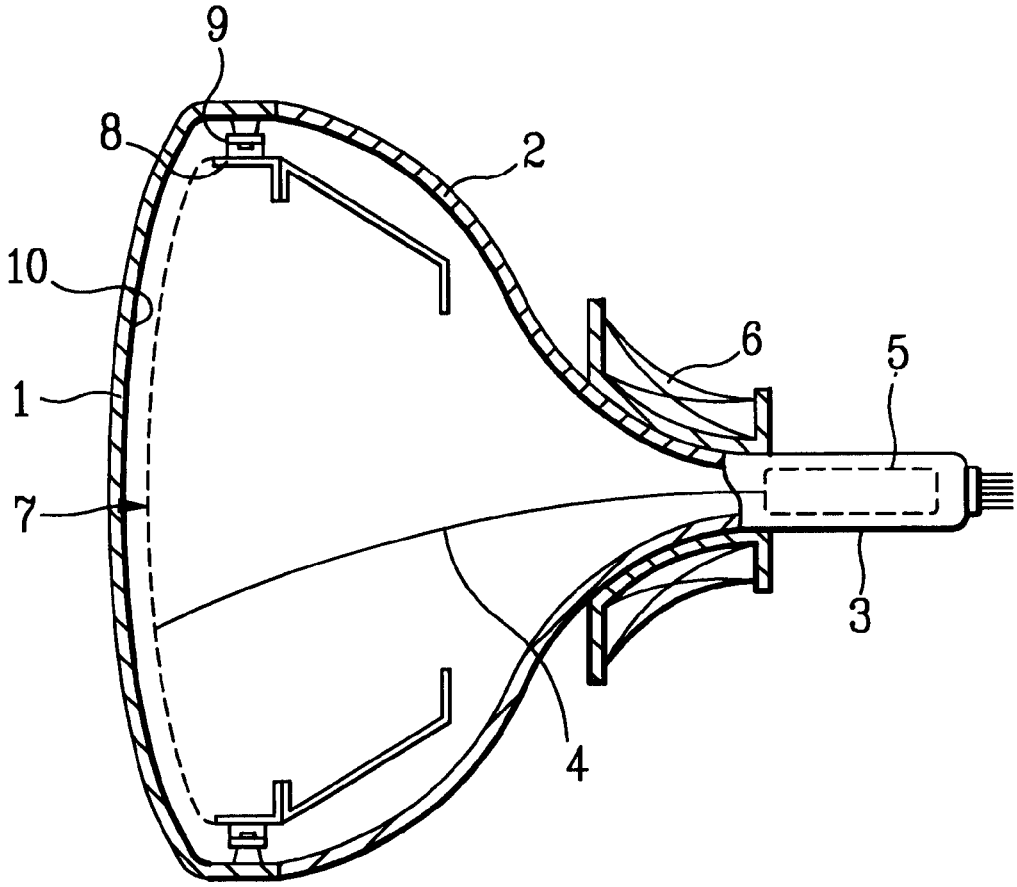
FIG.1 Related Art
FIG. 1 illustrates a section of a related art cathode ray tube.

Reference will now be made in detail to the preferred embodiments of the present invention, examples of which are illustrated in the accompanying drawings. Since a shadow mask in a color cathode ray tube is explained in the related art, explanation of the shadow mask will be omitted, and components of the present invention identical to the related art will be given the same reference numerals.

Figure 2:
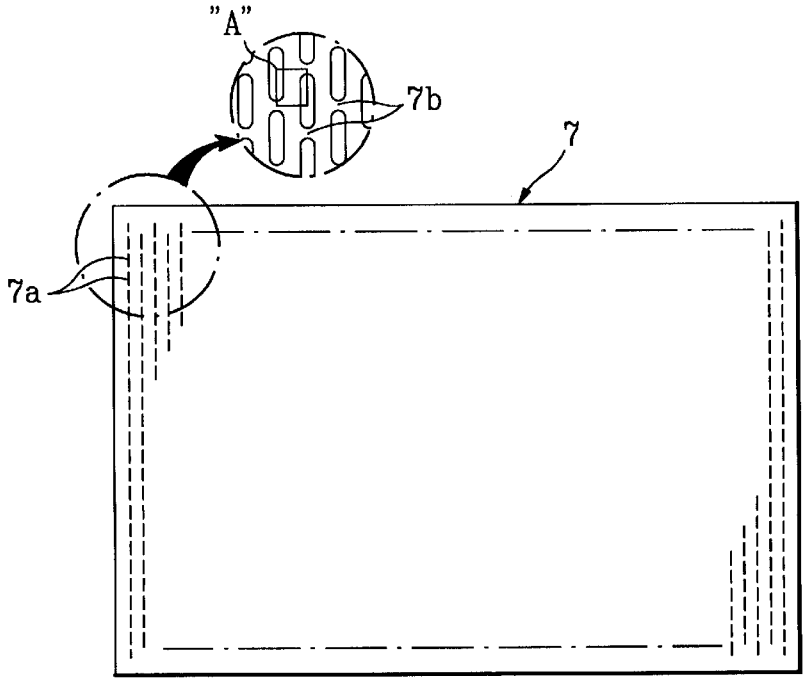
FIG.2 Related Art
FIG. 2 illustrates a front view of a related art shadow mask, schematically.
Figure 3:
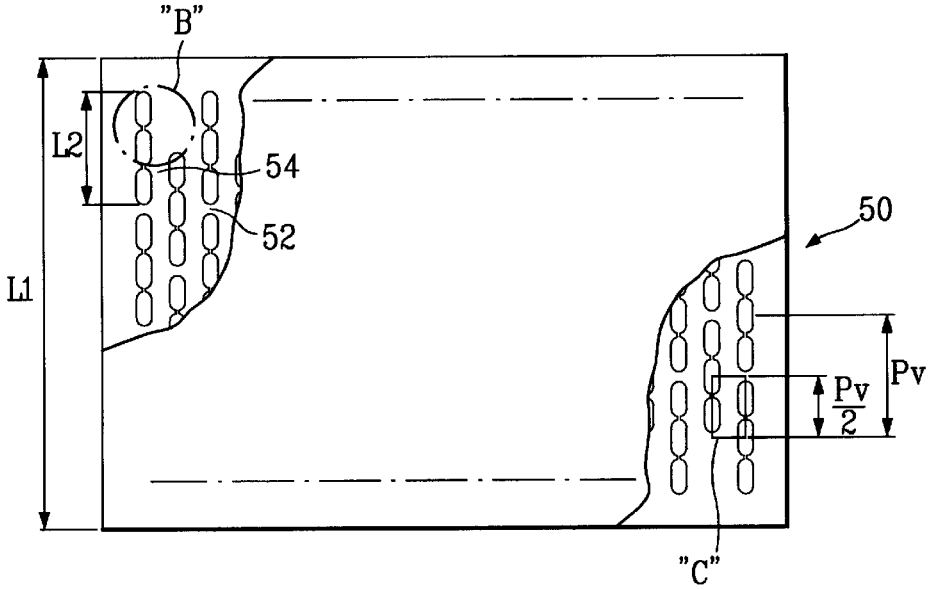
FIG. 3 illustrates a front view of a shadow mask in accordance with a preferred embodiment of the present invention, schematically.
Figure 4:
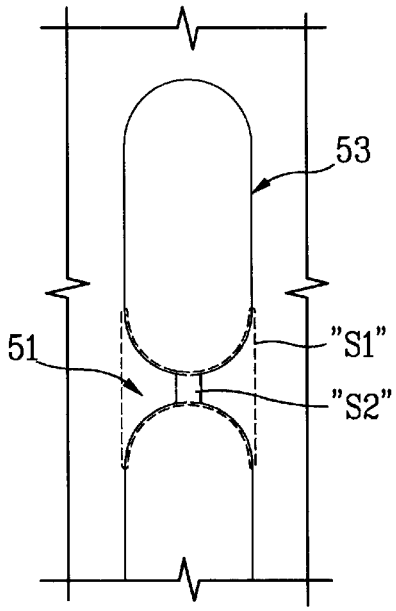
FIG. 4 illustrates an enlarged view of "B" part in FIG. 3 showing a first embodiment of an open bridge.

Referring to FIGS. 3 and 4, a shadow mask in a color cathode ray tube in accordance with a first preferred embodiment of the present invention includes a plurality of combined slots formed by removing bridges (see a reference numeral 7*b* in FIG. 2) to combine a number of adjacent slots (see reference numeral 7*a* in FIG. 2) in a height direction, such that an area S2 of the removal is 1~30% of a bridge area S1. That is, in the present invention, a portion of bridge is removed for a number of slots to combine the slots to form an open type bridge 51 (called as "open bridge"), to elongate the slot 53, which improves a luminance that is the most important characteristic of the cathode ray tube in view of a quality. The luminance is improved because the removal of the present bridges (see 7*b* in FIG. 7B) increases the amount of electron beams passing through the shadow mask (see 10 in FIG. 1), which makes the fluorescent film ruminant. Eventually, the improved luminance provides a brighter picture on the screen, to lessen tiredness in eyes of the user, and enhances a sharpness of color, as the colors formed by the electron beams hit onto the fluorescent film on the screen are sharp.

Moreover, the removal area S2 of the open bridge 51 (hereafter called as "open bridge area") of the present invention by approx. 1~30% of an entire bridge area S1 (hereafter called as "unit bridge area") provides so called bridge shadow removal effect, which will be explained in detail.

In general, the bridge shadow is formed as the electron beams are shadowed by the bridges of the shadow mask on a path of the electron beams, to show shadow on the screen as the electron beams can not reach to the fluorescent film. That is, if the open bridge area S2 is designed to be, not 1~30% of the unit bridge area S1 like the present invention, but 30~100% of the unit bridge area S1, though the luminance is improved as the removed area increases, the user becomes aware of the shadows of bridges as shadows of a limited number of bridges that are not opened are displayed scattered on the screen because the number of shadows formed by the bridges is reduced, significantly. Opposite to this, the design of the open bridge area S2 to be 1~30% of the unit bridge area S1 of the present invention prevents deterioration of resolution caused by the shadows and the fatal visibility of the shadows in advance. According to a simulation, the open bridge 51 of the present invention secures an optimal luminance, and forms lots of shadows of the bridges which the user can not be aware of on the screen, permitting to obtain a bridge shadow removal effect, substantially.

Figure 5:
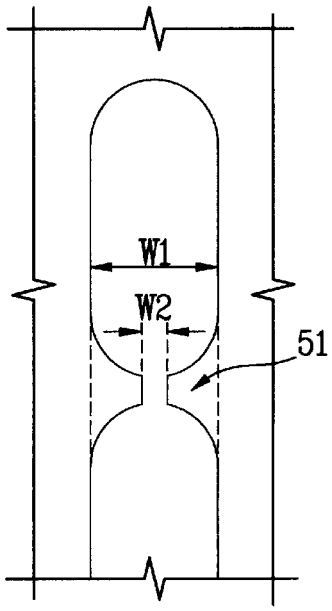
FIG. 5 illustrates an enlarged view of "B" part in FIG. 3 showing a second embodiment of an open bridge.

Referring to FIG. 5, in the shadow mask in a color cathode ray tube in accordance with a second preferred embodiment of the present invention having a plurality of slots (see 7*a* in FIG. 2) for passing the electron beams therethrough, as well as a bridge (see 7*b* FIG. 2) between adjacent slots in a height direction, a portion of each of the bridges is removed to combine a number of the slots, such that an opened width W2 of the bridge is 1~40% of a slot width W1. According to an experiment on the slot width W1 and the bridge open width W2, the bridge open width W2 is required to be 1~40% of the slot width W1 for obtaining the luminance and the bridge shadow elimination effect in the second preferred embodiment of the present invention. Moreover, it is preferable for the first or second embodiment shadow mask that a length L2 of the combined slot 53 is 0.05~50% of a height L1 of the shadow mask 50, and a vertical pitch Pv of the combined slot is 0.1~50% of the height L1 of the shadow mask, which is greater than the ratio of the length L2 of the combined slot to the height L1 owing to the unopened bridge.

The length L2 of the combined slot and the vertical pitch Pv are fixed thus under the following reasons.

First, if the length of the combined slot is greater than 50% of the length L1 of the shadow mask, the shadow mask 50 will have open bridges 51 only, which causes a strength problem. That is, making the ratio of the length L2 of the combined slot to the height L1 of the shadow mask greater than 50% drops strength of the vertical line part 54 between the combined slots 53, to cause deformation or damage during fabrication or packaging of the shadow mask 50 due to entangling of the vertical lines. Therefore, by fixing the length L2 of the combined slot thus, leaving the unopened bridges 52 at places, the strength of the vertical line part 54 can be maintained to an appropriate level.

If the vertical pitch Pv of the combined slot is smaller than 0.1% of the length L1 of the shadow mask, the shadow mask 50 will have unopened bridges 51 only, which causes the following doming problem. That is, the shadow mask will experience an increased effective elastic modulus in an X-axis direction to lower a critical temperature thereof, and heat generation higher than the critical temperature at the time of electron beam passing, to be liable to cause a large deformation in the X-axis direction to displace the slots 53 which are exactly aligned with the fluorescent film (see reference numeral 10 in FIG. 1) of a uniform array of red, green, and blue colors. Consequently, the electron beams can not hit the fluorescent film exactly, that makes a color purity poor, which will be explained by using the following equations.

$$(E_x)_{eff} = \frac{(\sigma_x)_{eff}}{(\varepsilon_x)_{eff}} = \frac{2 \times F_x}{P_v} \times \left(\frac{P_h}{h}\right) \quad (1)$$

Where, $E_x$ denotes an effective elastic modulus in X-axis direction, $F_x$ denotes a tension in X-axis direction, $P_v$ denotes a vertical pitch, $P_h$ denotes a horizontal pitch, and h denotes a vertical displacement.

$$\epsilon_p - \epsilon_t = 0,\ \epsilon_p = \frac{P}{A \times E},\ \text{and}\ \epsilon_t = \alpha \times \Delta T, \quad (2)$$

$$\therefore \Delta T = \frac{P}{\alpha A E}$$

Where, $\epsilon_p$ denotes strain by tension, $\epsilon_t$ denotes strain by a heat load, P denotes tension load, A denotes a sectional area, E denotes an effective elastic modulus, $\alpha$ denotes a thermal expansion coefficient, and $\Delta T$ denotes a critical temperature.

Figure 6:
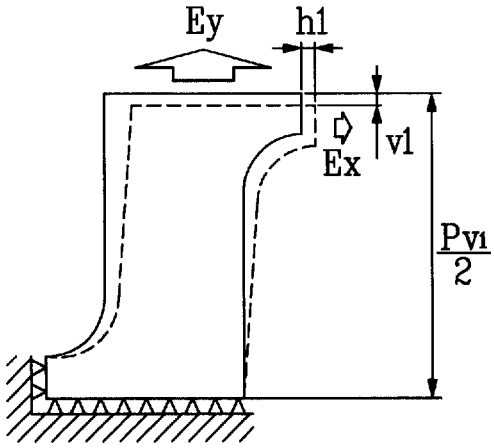
FIG. 6 illustrates an enlarged view of "A" part in FIG. 2 showing a general vertical pitch of a slot.
Figure 7:
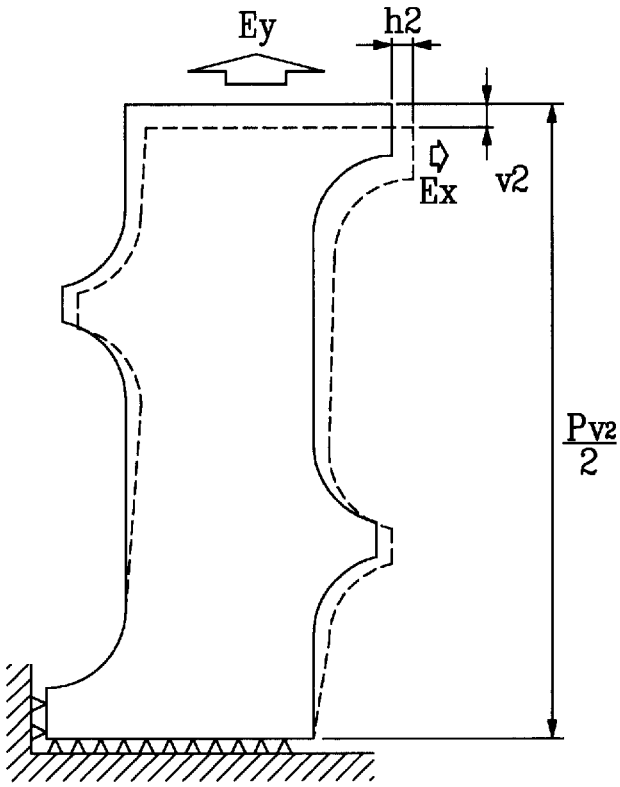
FIG. 7 illustrates an enlarged view of "C" part in FIG. 3 showing a vertical pitch of a combined slot in accordance with a preferred embodiment of the present invention.

FIG. 6 illustrates an enlarged view of "A" part in FIG. 2 showing a general vertical pitch of a slot, and FIG. 7 illustrates an enlarged view of "C" part in FIG. 3 showing a vertical pitch of a combined slot in accordance with a preferred embodiment of the present invention.

X-axis elastic modulus of the shadow mask with the general slots shown in FIG. 6 and the shadow mask with combined slots shown in FIG. 7 are compared by using equations (1) and (2), to obtain the following result. Upon application of the same tension to the general shadow mask (hereafter called as "simple shadow mask") shown in FIG. 6 and to the shadow mask with the combined slot (hereafter called as "combined shadow mask") shown in FIG. 7, a horizontal displacement of the simple shadow mask is smaller than the horizontal displacement of the combined shadow mask, and a vertical displacement of the simple shadow mask is smaller than the vertical displacement of the combined shadow mask. Therefore, upon application of the displacements to the equation (1), the X-axis effective elastic modulus of the simple shadow mask is greater than the X-axis effective elastic modulus of the combined shadow mask. Moreover, upon application of the X-axis effective elastic modulus to the equation (2), it can be known that the critical temperature of the simple shadow mask is lower than the critical temperature of the combined shadow mask. In conclusion, it can be known that the simple shadow mask is liable to be involved in an ambient a temperature thereof exceeds the critical temperature by the heat from the electron beams, to be displaced in X-axis direction greater than the combined shadow mask that has a higher critical temperature. Accordingly, it is favorable to use the combined shadow mask having a pitch of the combined slot greater than 0.1% of a height of the shadow mask, for accurate hitting on the fluorescent film by the electric beams, to enhance a color purity and prevent doming.

On the other hand, it is preferable that the combined slot (see reference numeral 53 in FIG. 4) has 1~200 open bridges. (see reference numeral 51 in FIG. 4). Because, as explained before, the problems of doming, strength, and Moiré can be solved, in combination. That is, if there is no open bridge 51 in the combined slot, the vertical pitch (see Pv in FIG. 3) is reduced, that reduces the critical temperature, and, if a number of the open bridges are more than 200 in the combined slot, with poor strength, the vertical line parts (see reference numeral 54 in FIG. 4) entangle during fabrication, packaging and transportation. Consequently, it is known from a simulation that provision of 1~200 open bridges can prevent doming, and reinforce the strength.

Figure 8:
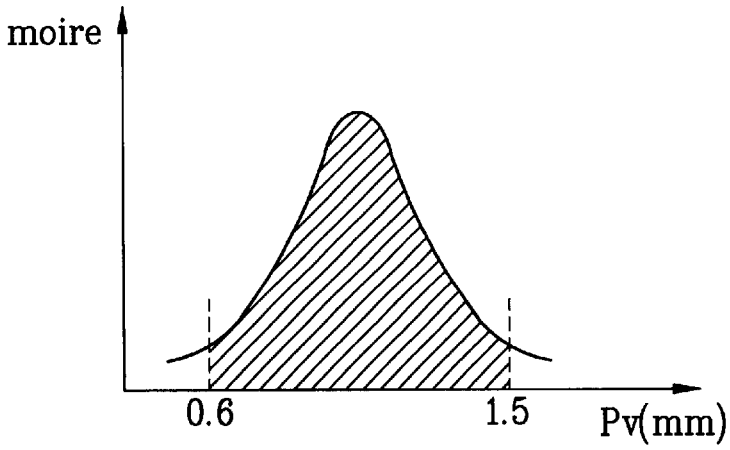
FIG. 8 illustrates a graph showing a range of moiré occurrence caused by a vertical pitch.

FIG. 8 illustrates a graph showing a range of moiré occurrence caused by a vertical pitch, wherein it can be known that a vertical pitch Pv outside of a range of 0.6 mm~1.5 mm can prevent moiré in advance. The moiré is an interference of a wave of the electron beam caused by the slot and a wave of the electron beam itself, to form waves of certain widths moving on the screen, repeatedly.

Figure 9:
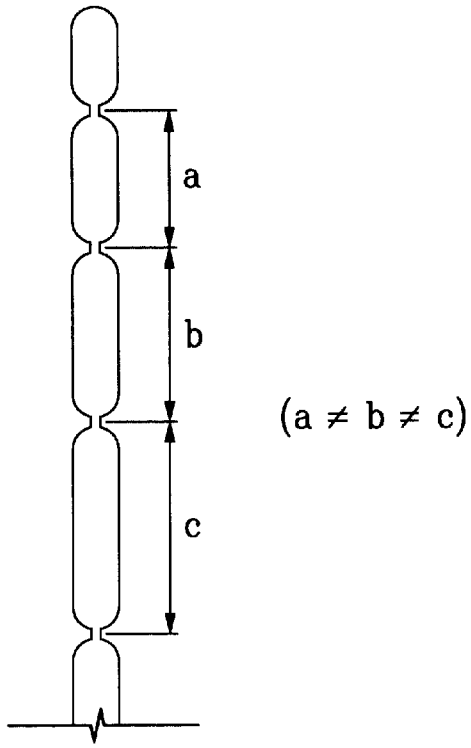
FIG. 9 illustrates an enlarged view of a key part showing intervals of open bridges in a combined slot in accordance with a preferred embodiment of the present invention.

FIG. 9 illustrates an enlarged view of a key part showing intervals of open bridges in a combined slot in accordance with a preferred embodiment of the present invention, wherein the intervals 'a', 'b', and 'c' may differ, which may vary with a function, to be gradually greater or smaller, or a combination of the two, for reinforcement of the strength of the shadow mask.

Figure 10A:
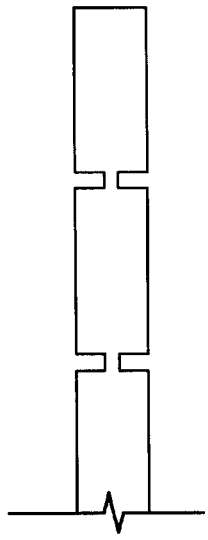
FIG. 10A illustrates an enlarged view of a key part showing a form of a combined slot in accordance with a first preferred embodiment of the present invention.
Figure 10B:
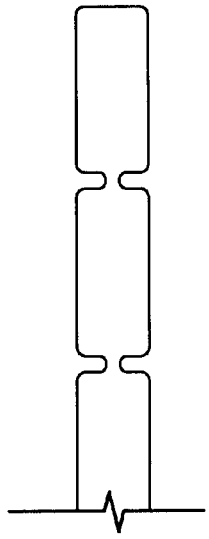
FIG. 10B illustrates an enlarged view of a key part showing a form of a combined slot in accordance with a second preferred embodiment of the present invention.

FIG. 10A illustrates an enlarged view of a key part showing a form of a combined slot in accordance with a first preferred embodiment of the present invention, and FIG. 10B illustrates an enlarged view of a key part showing a form of a combined slot in accordance with a second preferred embodiment of the present invention. As shown in FIG. 10A, the slot may be rectangular for reducing a luminance difference between the open bridge and the unopened bridge, or the rectangular corners may be rounded. As shown in FIGS. 9~10B, a center portion of the bridge may be opened to form the open bridge.

Figure 11A:
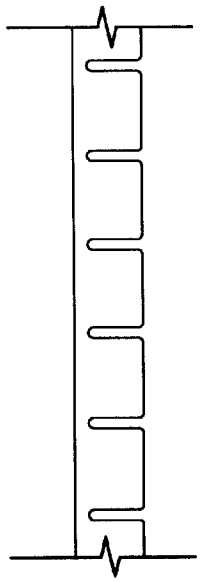
FIG. 11A illustrates an enlarged view of a key part showing an arrangement of open bridges in a combined slot in accordance with a first preferred embodiment of the present invention.
Figure 11B:
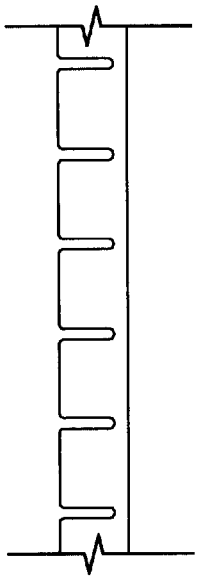
FIG. 11B illustrates an enlarged view of a key part showing an arrangement of open bridges in a combined slot in accordance with a second preferred embodiment of the present invention.
Figure 11C:
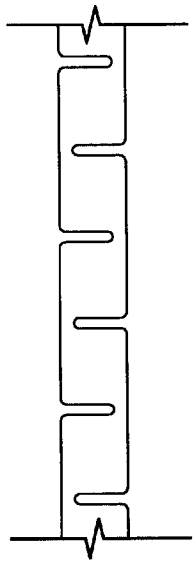
FIG. 11C illustrates an enlarged view of a key part showing an arrangement of open bridges in a combined slot in accordance with a third preferred embodiment of the present invention.
Figure 11D:
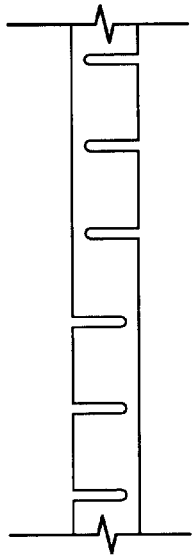
FIG. 11D illustrates an enlarged view of a key part showing an arrangement of open bridges in a combined slot in accordance with a fourth preferred embodiment of the present invention.
Figure 11E:
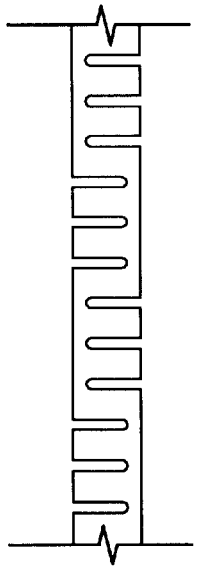
FIG. 11E illustrates an enlarged view of a key part showing an arrangement of open bridges in a combined slot in accordance with a fifth preferred embodiment of the present invention; and, FIG. 11F illustrates an enlarged view of a key part showing an arrangement of open bridges in a combined slot in accordance with a sixth preferred embodiment of the present invention.
Figure 11F:
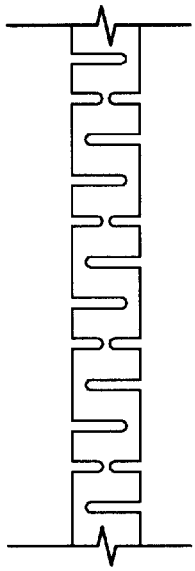

There may be different forms of combined slots and open bridges, which will be explained with reference to the attached drawings. FIG. 11A illustrates an enlarged view of a key part showing an arrangement of open bridges in a combined slot in accordance with a first preferred embodiment of the present invention, FIG. 11B illustrates an enlarged view of a key part showing an arrangement of open bridges in a combined slot in accordance with a second preferred embodiment of the present invention, FIG. 11C illustrates an enlarged view of a key part showing an arrangement of open bridges in a combined slot in accordance with a third preferred embodiment of the present invention, FIG. 11D illustrates an enlarged view of a key part showing an arrangement of open bridges in a combined slot in accordance with a fourth preferred embodiment of the present invention, FIG. 11E illustrates an enlarged view of a key part showing an arrangement of open bridges in a combined slot in accordance with a fifth preferred embodiment of the present invention, and FIG. 11F illustrates an enlarged view of a key part showing an arrangement of open bridges in a combined slot in accordance with a sixth preferred embodiment of the present invention.

Referring to FIG. 11A, a left portion of the bridge may be opened to form the open bridge. As shown in FIG. 11B, a right portion of the bridge may be opened to form the open bridge. As shown in FIG. 11C, left and right portions of the bridge may be opened alternately to form the open bridges. As shown in FIG. 11D, the left portion of the bridge may be opened for a number of bridges in succession, and then, alternately, the right portion of the bridge may be opened for a number of bridges in succession, to form the open bridges, or as shown in FIG. 11E, the foregoing cycle in the FIG. 11D may be repeated. Or, as shown in FIG. 11F, open bridges with the right portion opened, center portion opened, and right portion opened may be arranged in a sequence at different intervals, repeatedly. Thus, though there is no description, different combined slots and open bridges may be employed in the shadow mask of the present invention within a range the first and second embodiments are met, and there may be lots of forms shadow mask if the different combined slots and open bridges are applied thereto.

In the meantime, referring to FIG. 4 again, the shadow mask of the present invention is fabricated by removing a center portion of a bridge (see reference numeral 7*b* in FIG. 2) between adjacent slots (see reference numeral 7*a* in FIG. 2) in a height direction, to combine a number of the slots, wherein, preferably, a removal area S2 is made to be 1~20% of the bridge area S1, because removal of the center portion increases diffraction of lights. That is, as explained in the first preferred embodiment of the present invention, if the removal area from the center portion exceeds 20% of the bridge area, diffraction of lights through additionally removed areas at left and right of the center portion increases additionally, to improve the luminance, the aforementioned bridge shadow elimination effect may be poor. Therefore, it is preferable that the removal area S2 is smaller than the first embodiment, if the center portion of the bridge is removed, such that the removal area S2 is 1~20% of the bridge area S1. Or, alternatively, the shadow mask of the present invention is fabricated by removing a center portion of a bridge (see reference numeral 7*b* in FIG. 2) between adjacent slots (see reference numeral 7*a* in FIG. 2) in a height direction, to combine a number of the slots, wherein, preferably, an open width W2 of the bridge is made to be 1~25% of a slot width W1, because removal of the center portion increases diffraction of lights in the reason explained before. Therefore, it is preferable that the open width is smaller than the second embodiment, if the center portion of the bridge is removed, such that the open width W2 is 1~25% of the slot width W1.

The shadow mask in a color cathode ray tube of the present invention has the following advantages.

First, the luminance of the color cathode ray tube, an important characteristic of the color cathode ray tube, can be increased.

Second, moiré, a light interference pattern, can be eliminated, effectively.

Third, doming by heat can be prevented in advance.

Fourth, the bridge shadow removal effect can be provided, in which user is aware of the bridge shadow.

Fifth, because the different combined slots and open bridges can be employed, there are individual advantages for each of the combinations of the combined slots and open bridges.

It will be apparent to those skilled in the art that various modifications and variations can be made in the shadow mask in a color cathode ray tube of the present invention without departing from the spirit or scope of the invention. Thus, it is intended that the present invention cover the modifications and variations of this invention provided they come within the scope of the appended claims and their equivalents.

What is claimed is:

1. A shadow mask in a color cathode ray tube, comprising:

a plurality of slots for passing electron beams therethrough; and a bridge between adjacent slots in a height direction, wherein a center portion of the bridge between adjacent slots is removed to combine a number of the slots, such that a removal area of the bridge is 1~20% of an area of the bridge and wherein a combined slot formed by the combination of the slots has a length 0.05~50% of a height of the shadow mask.

2. The shadow mask as claimed in claim 1, wherein the open bridge in the combined slot formed by a combination of the slots includes an opened portion in a right portion of the bridge.

3. The shadow mask as claimed in claim 1, wherein the open bridges in the combined slot formed by a combination of the slots includes opened portions in a left portion of the bridge, in a center portion of the bridge, and in a right portion of the bridge arranged in a sequence at different intervals, repeatedly.

4. The shadow mask as claimed in claim 1, wherein a combined slot formed by the combination of the slots has a vertical pitch 0.1~50% of a height of the shadow mask.

5. The shadow mask as claimed in claim 1, wherein a combined slot formed by the combination of the slots includes 1~200 open bridges.

6. The shadow mask as claimed in claim 1, wherein a combined slot formed by the combination of the slots includes open bridges arranged at different intervals.

7. The shadow mask as claimed in claim 1, wherein a combined slot formed by the combination of the slots includes open bridges arranged at intervals dependent on a function.

8. The shadow mask as claimed in claim 7, wherein the function gradually increases the intervals of the open bridges.

9. The shadow mask as claimed in claim 7, wherein the function gradually decreases the intervals of the open bridges.

10. The shadow mask as claimed in claim 7, wherein the function is a combination of a function that gradually increases the intervals of the open bridges with a function that gradually decreases the intervals of the open bridges.

11. The shadow mask as claimed in claim 1, wherein the combined slot formed by combination of the slots is rectangular for reducing a luminance difference between the open bridge and the unopened bridge.

12. The shadow mask as claimed in claim 11, wherein the rectangle includes rounded corners.

13. The shadow mask as claimed in claim 1, wherein the open bridge in the combined slot formed by a combination of the slots includes an opened portion in a left portion of the bridge.

14. The shadow mask as claimed in claim 1, wherein the open bridges in the combined slot formed by combination of the slots include opened portions in a left portion and a right portion of the bridges, alternately.

15. The shadow mask as claimed in claim 14, wherein the open bridges in the combined slot formed by combination of the slots include opened portions in left portions of the bridges for a number of bridges in succession and in right portions of the bridges for the number of bridges in succession, repeatedly to form one cycle.

16. The shadow mask as claimed in claim 15, wherein the cycle is repeated.

17. A shadow mask in a color cathode ray tube, comprising:

a plurality of slots for passing electron beams therethrough; and, a bridge between adjacent slots in a height direction, wherein a center portion of the bridge between adjacent slots is removed to combine a number of the slots, such that an opened width of the bridge formed by the removal of the bridge is 1~25% of a width of the slot and wherein a combined slot formed by the combination of the slots has a length 0.05~50% of a height of the shadow mask.

18. The shadow mask as claimed in claim 17, wherein a combined slot formed by the combination of the slots has a vertical pitch 0.1~50% of a height of the shadow mask.

19. The shadow mask as claimed in claim 17, wherein a combined slot formed by the combination of the slots includes 1~200 open bridges.

20. The shadow mask as claimed in claim 17, wherein a combined slot formed by the combination of the slots includes open bridges arranged at different intervals.

21. A shadow mask as claimed in claim 17, wherein the combined slot formed by combination of the slots is rectangular for reducing a luminance difference between the open bridge and the unopened bridge.

* * * * *